United States Patent [19]

Bonanno

[11] Patent Number: 4,630,520

[45] Date of Patent: Dec. 23, 1986

[54] GUITAR CONTROLLER FOR A MUSIC SYNTHESIZER

[76] Inventor: Carmine Bonanno, 820 Rushmore Ave., Mamaroneck, N.Y. 10543

[21] Appl. No.: 669,666

[22] Filed: Nov. 8, 1984

[51] Int. Cl.[4] ..... G10H 3/18

[52] U.S. Cl. ..... 84/1.16; 84/1.18; 84/DIG. 30

[58] Field of Search ..... 84/1.16, 1.18, DIG. 30

[56] References Cited

U.S. PATENT DOCUMENTS

| | | | |
|---|---|---|---|
| 2,500,172 | 3/1950 | Gillenwater . | |
| 3,297,813 | 1/1967 | Cookerly et al. | 84/1.16 |
| 3,524,375 | 8/1970 | Hopping . | |
| 3,530,227 | 9/1970 | Wheeler et al. . | |
| 3,555,166 | 1/1971 | Gasser . | |
| 3,673,304 | 6/1972 | Dudas . | |
| 3,694,559 | 9/1972 | Suzuki et al. . | |
| 3,733,953 | 5/1973 | Ferber | 84/1.16 |
| 3,742,114 | 6/1973 | Barkan . | |
| 3,786,187 | 1/1974 | De Vita et al. . | |
| 4,010,668 | 3/1977 | Plueddeman . | |
| 4,052,923 | 10/1977 | Cohn . | |
| 4,143,575 | 3/1979 | Oliver . | |
| 4,235,141 | 11/1980 | Eventoff . | |
| 4,235,144 | 11/1980 | Lubow et al. | 84/1.16 |
| 4,263,520 | 4/1981 | Kajihata et al. . | |
| 4,306,480 | 12/1981 | Eventoff et al. . | |
| 4,321,463 | 3/1982 | Stecher . | |
| 4,321,852 | 3/1982 | Young . | |
| 4,336,734 | 6/1982 | Polson . | |
| 4,357,852 | 11/1982 | Suenaga . | |
| 4,372,187 | 2/1983 | Berg . | |
| 4,429,607 | 2/1984 | Meno . | |
| 4,430,917 | 2/1984 | Pepper, Jr. . | |
| 4,442,750 | 4/1984 | Bowley . | |
| 4,468,997 | 9/1984 | Young, Jr. . | |
| 4,472,994 | 9/1984 | Armstrong | 84/1.16 X |
| 4,563,931 | 1/1986 | Siebeneiker et al. | 84/1.16 |

OTHER PUBLICATIONS

Musicians's Guide for Todays Musician—Aug. 1977, No. 23 (62800), p. 16–21 and p. 22–24.

Hall Effect Pickup for Stringed Musical Instruments by Robert M. Iodice-AES (an audio engineering society preprint) No. 1394 (J-4) (booklet) presented at the 61st Convention, Nov. 3–6, 1978 New York.

Electronotes (52) Newsletter of the Musical Engineering Group—vol. 7, No. 52, Apr. 1975—p. 1–22.

An Integrated Guitar Synthesizer for Live Performance by David Fried-AES (an audio engineering society preprint) No. 1289 (E-6) (booklet) presented at the 58th Convention, Nov. 4–7, 1977 New York.

*Primary Examiner*—Stanley J. Witkowski

*Attorney, Agent, or Firm*—Karl F. Ross; Herbert Dubno

[57] ABSTRACT

A guitar controller for an electronic music synthesizer utilizes a multiplexed string energization and fret acquisition system wherein a high impedance buffer allows voltages to be detected off the strings at the various frets without drawing current through the frets or fret/-string contacts. Unique string bend and string vibration sensors and expression auxiliary sensors are additionally disclosed.

27 Claims, 29 Drawing Figures

MULTIPLEXED FRET / STRING SYSTEM

GUITAR CONTROLLER FOR A MUSIC SYNTHESIZER

CROSS REFERENCE TO RELATED APPLICATION

This application is related to my copending application Ser. No. 560,942 filed Oct. 13, 1983 and now U.S. Pat. No. 4,580,479 as a continuation-in-part of my application Ser. No. 470,716 filed Feb. 28, 1983 and since issued as U.S. Pat. No. 4,468,999.

FIELD OF THE INVENTION

My present invention relates to a guitar controller for a music synthesizer and, more particularly, to a device which can be played (plucked or strumed) with as faithful a manipulation as possible to that of an electric guitar, but which can be utilized as an input device for a music synthesizer.

The invention also relates to a method of operating a guitar controller for an electronic music synthesizer.

BACKGROUND OF THE INVENTION

When I refer herein to an electronic music synthesizer, I am referring to a unit capable of receiving signals from some kind of controller which directs the unit to electronically synthesize a tone or modulate or modify it in accordance with the instructions or signals from the controller and/or in accordance with preprogrammed modes. The preferred electronic music synthesizer is the programmable apparatus described in the aforementioned patent, while the typical application of a keyboard for such a music synthesizer is described in the copending application also identified above.

In the past, electronic music synthesizers have principally been the domain of keyboard players because it was relatively easy to design switching-type keyboards as inputs for music synthesizers. However, guitar players and musicians concerned with versatility also have evidenced the desire to be able to provide greater inputs for electronic music synthesizers utilizing the standard guitar-playing techniques.

In my copending application Ser. No. 560,942 filed Oct. 13, 1983 and now U.S. Pat. No. 4,580,479, I have described a sophisticated guitar controller for an electronic music synthesizer having a degree of versatility and an assortment of controls which were capable of delivering expression, note selection, amplitude and modulating information to the synthesizer. This system, however, required the highly specialized constructions of string simulators and fret simulators which were not always satisfactory for a natural feel to the guitar player.

It is thus highly desirable to be able to provide a guitar controller having a more natural feel and especially one which can use the strings and frets of a guitar to provide the information required for the music synthesizer.

Other desiderata of such a controller include the ability to work through a standard MIDI (Music Instrument Digital Interface), i.e. the standard format adopted by the music industry for inputs to electronic music generating systems.

In the past, as will be apparent from the discussions of the critical components of a guitar controller in accordance with the invention below, efforts have been made to utilize the string and fret combinations of signals for the note selection. These systems have concentrated upon electronics which have utilized each string and fret junction as a switch and systems which have provided resistance bridges including the string resistance between a pair of frets and resistances in series with each of the frets simultaneously contacted by a respective string to signal, e.g. via a scanning system, fret acquisition and, therefore, for the depressed string, the respective note represented by the free-length of the string between the bridge and the lowest of the frets engaged by the depressed string.

Various techniques have been utilized to signal which of the strings were depressed as well.

All of these earlier systems are fraught with various problems and drawbacks obviated by the present invention and some of which will be detailed below.

At this point it is merely important to note that critical to the accurate operation of the fret acquisition system, i.e. detecting the lowest fret against which a spring may be depressed on the key fret, is the fact that this detection must be devoid of the problems which can occur if electrical contact between the conductive string and the conductive fret develops a resistance which somehow interferes with the ability to accurately determine the selected fret.

In early experiments with the approach in which a bridge is formed by the resistance of a string between two frets with which it is in contact, the resistances of these frets, such contact resistance was found to be prohibitively large, at least with long-term use of the instrument and the passage of the comparatively high electric currents through the strings which were required to generate an adequate potential difference for measurement of fret resistance. Consequently, while fret resistance provided a theoretical possibility for fret acquisition, in practical terms fret acquisition utilizing a resistance determination was found to be unsatisfactory even when expensive expedients were followed to make the contact of as low resistance type as possible.

OBJECTS OF THE INVENTION

It is, therefore, the principal object of the present invention to provide a guitar controller which can be operated or played utilizing the same manipulative techniques as used to play a standard guitar and which can employ conventional guitar string and frets without the drawbacks of earlier systems and especially with the long-term stability and precision required for musical instruments.

Another object of this invention is to provide a more versatile guitar controller for an electronic music synthesizer which can allow the operator to control more characteristics or parameters of the music to be generated in a more efficient manner than has been possible heretofore.

Still another object is to extend the principles of my earlier application as listed above.

Yet another object of the invention is to provide an improved method of operating a guitar controller so that disadvantages of earlier systems are excluded.

SUMMARY OF THE INVENTION

A. General

These objects and others which will become apparent hereinafter are attained, in accordance with the present invention, in a method of detecting note selection in a guitar having a plurality of frets spaced apart along a fret board formed on a neck of the guitar and a plurality of guitar strings extending along the neck over the frets.

According to the invention, an electric current is passed through each of these strings whereby a voltage gradient is established along each string at least in a region thereof overlying the frets, i.e. along the fret board, a voltage forming part of this gradient of each string being measured from the depression thereof into contact with a respective fret without drawing significant electrical current through the point of contact or altering substantially the gradient, thereby determining the free tone-generating length of the respective string. An electronic music synthesizer, especially the one described in my aforementioned U.S. Patent, is controlled in accordance with the measured voltage.

Specifically, I have discovered that the fret acquisition problems heretofore encountered can be completely eliminated while retaining the desired feel of the frets and strings, by utilizing a high impedance buffer to measure the voltage at the specific fret and forming part of the voltage gradient for a depressed string, this high impedance buffer minimizing the current drawn through the fret so that the detection of the note or the key fret is independent of contact resistance or like interfering parameters.

In its apparatus aspects, therefore, a guitar controller in accordance with the invention has a guitar body, a neck extending from this body, an array of transversely spaced mutually parallel electrically conductive guitar strings extending along this neck from a nut at an upper end thereof to a bridge on the body, and a multiplicity of electrically conductive frets extending in transversely spaced relationship across the area of strings on the neck and below the strings whereby the strings are depressed against the frets for note selection.

In its broadest aspect, therefore, the fret acquisition system includes means for passing an electric current through each of the strings at least in a region in which the strings overlie the frets whereby a voltage gradient is established along each string. Means including at least one high impedance buffer is connected to the frets for measuring a voltage forming part of the gradient of each string upon the depression thereof into contact with a respective fret without drawing significant electric current through the point of contact or altering substantially the gradient along the string, thereby determining the key fret and the free tone-generating length of the respective string. Means is connected to this measuring means for controlling the music synthesizer to generate a corresponding tone in accordance with the measured voltage.

B. Fret Acquisition System

According to a feature of the invention, the fret acquisition system which determines the fret position which is active for each string, can include a multiplexer connected between the buffer and the frets for multiplexing the frets to the buffer. In addition, the means for passing the electric current through each of the strings can include a multiplexer and a constant current source as well as a current sink or drain jointly multiplexed to each of the strings in turn by the multiplexer.

Furthermore, the measuring means can include means for selectively scanning the frets for each string from the fret closest to the body to the fret closest to the nut so that a response to the first fret in each such cycle will signal the key fret for note-determining purposes.

C. A String Vibration Sensor

A string vibration sensor can be provided on the body in accordance with the present invention, to generate amplitude signals which are utilized as an input to the music synthesizer for controlling the output of the tone selected by the fret acquisition system. This sensor can be provided with a direct acoustic output which can be picked up by a microphone forming part of the synthesizer and blending with the electrically generated sound. Hence the vibration sensor is the counterpart of the pick-up previously provided on an electric guitar.

An individual vibration sensor is provided for each string so that the amplitude information can be processed independently, the sensing signal being utilized to control the amplitude of the respective synthesizer voices for each string (6 for string guitar and 4 for bass). The processing signals may, however, be utilized individually, severally, or collectively to control other parameters on the synthesizer.

According to this invention, the string vibration sensor defines for the synthesizer the inception and termination of the corresponding tone. Each string vibration sensor can include a photoelectric emitter-detector pair straddling a respective string and forming a photointerrupter, means for determining a slope of a signal generated by the photointerrupter to establish the inception of the corresponding tone and an automatic gain circuit increasing the gain of a signal outputted thereby to maximize the duration of the corresponding tone to termination.

When the photointerrupter is provided, in accordance with the invention, the emitter/detector pairs can be located in a plane perpendicular to the neck or body and strings of the guitar with their optic axes in line with the holes so as to minimize the ambient light effect on the photointerrupters. Alternatively the emitter/detector pairs may be disposed athwart the strings in a line parallel to the frets, a cover being applied over the photointerrupter array.

The effect of ambient lighting can be eliminated, as will be described in detail below, by connecting each of the detectors to a digital filter synchronized to a digitally controlled control frequency and an arriving frequency that modulates the emitters whereby the synchronization of the modulating frequency to the digitally controlled center frequency eliminates any adverse effects of lighting upon the sensors.

A further feature of the invention provides a microprocessor to scan the strings, the vibrating sensor having a full-wave rectifier receiving the output of the sensor and a fast peak detector connected thereto for generating an interrupt signal for the microprocessor to exclude scanning of inactive strings.

D. Bend Sensors

According to a feature of the invention, a bend sensor is provided for each string to sense the off-axial movement of a string when it is bent, the resulting signal being utilized to control pitch and/or to control other parameters of the synthesizer.

The bend sensor can also comprise a photoelectric emitter-detector pair straddling each string and forming a photointerrupter. Again to minimize the influence of ambient light, the emitter-detector pairs are disposed in a support plate perpendicular to the neck and to the string, with holes being provided in this support perpendicular to the plane being along the optical axes of the planes. The support can here form the nut of the guitar. Here too the emitter-detector pairs can be in a row parallel to the bridge.

The detectors of these pairs may also be connected to an ambient light-reflecting system comprising a digital filter receiving outputs from the detectors and having a digitally controlled center frequency synchronized at a control frequency and a driving frequency that modulates the emitter of the plane whereby synchronization of the modulating frequency at the digitally controlled frequency eliminates any effect of ambient light on the response of the sensors.

An alternative construction of the bend sensors is a combination of a magnet and a Hall effect detector mounted on the nut adjacent the respective string and responsive to the bending thereof.

In yet another alternative, the bend sensors each include a light source and receiver disposed adjacent one another and trained upon the string so that the receiver forms a reflection detector with respect to which the string forms a reflector.

E. Auxiliary Controller

As observed in the copending application, it is advantageous to provide a guitar controller with other auxiliary controllers for regulating expression and other parameters of the music generated by the synthesizer, each of the auxiliary controller feeding the electronic music synthesizer. These inputs may be first applied to or are transmitted to the host synthesizer, by a host microprocessor capable of processing the data acquired by the peripheral support units and including, or being associated with, analog-to-digital converters, digital-to-analog converters and related circuitry. The purpose of the host microprocessor is to convert the controller data into the MIDI format so that the output can be delivered to the host synthesizer on this format for controlling the voice parameters of the synthesizer.

According to the invention, these auxiliary controllers include a neck pressure controller, a pickguard pressure controller, a foot pedal controller and a hand switch controller.

The hand switch controller can be simply a switch available near the strumming hand, preferably on the pickguard, and which is useful to activate the various synthesizer functions when operated. In addition, a thumb rest controller and a body-strike controller can be provided according to the invention.

The thumb rest controller can comprise a thumb rest adjacent to the string and means responsive to the thumb pressure on the thumb rest for outputting a control signal to the synthesizer.

The body-strike transducer or the body of the guitar is a vibration-electrical transducer responsive to blows applied to the body by a player for outputting a control signal representing amplitude of vibrations of the body induced by blows applied thereto. The output is supplied to the synthesizer as will be described.

The pickguard controller includes a pressure-electrical transducer responsive to pressure applied to the pickguard for generating a control signal which is applied to the synthesizer.

The foot pedal controller advantageously has a pedal forming a movable member or connected to a movable member shiftable by the foot of a player and variably reflecting an infrared beam from a source of infrared radiation to a receiver which outputs a control signal which can be applied to the synthesizer.

A pressure sensor in the neck is responsive to movement by the hand of the player for producing a control signal which is applied to the synthesizer from the neck pressure sensor.

Finally, a pressure sensor on the body may be operated by the heel of the strumming hand of the player for producing the control signal which is applied to the synthesizer.

BRIEF DESCRIPTION OF THE DRAWING

The above and other objects, features and advantages of the present invention will become more readily apparent, reference being made to the accompanying drawing, in which.

SPECIFIC DESCRIPTION

A. General

Figures 1, 2:
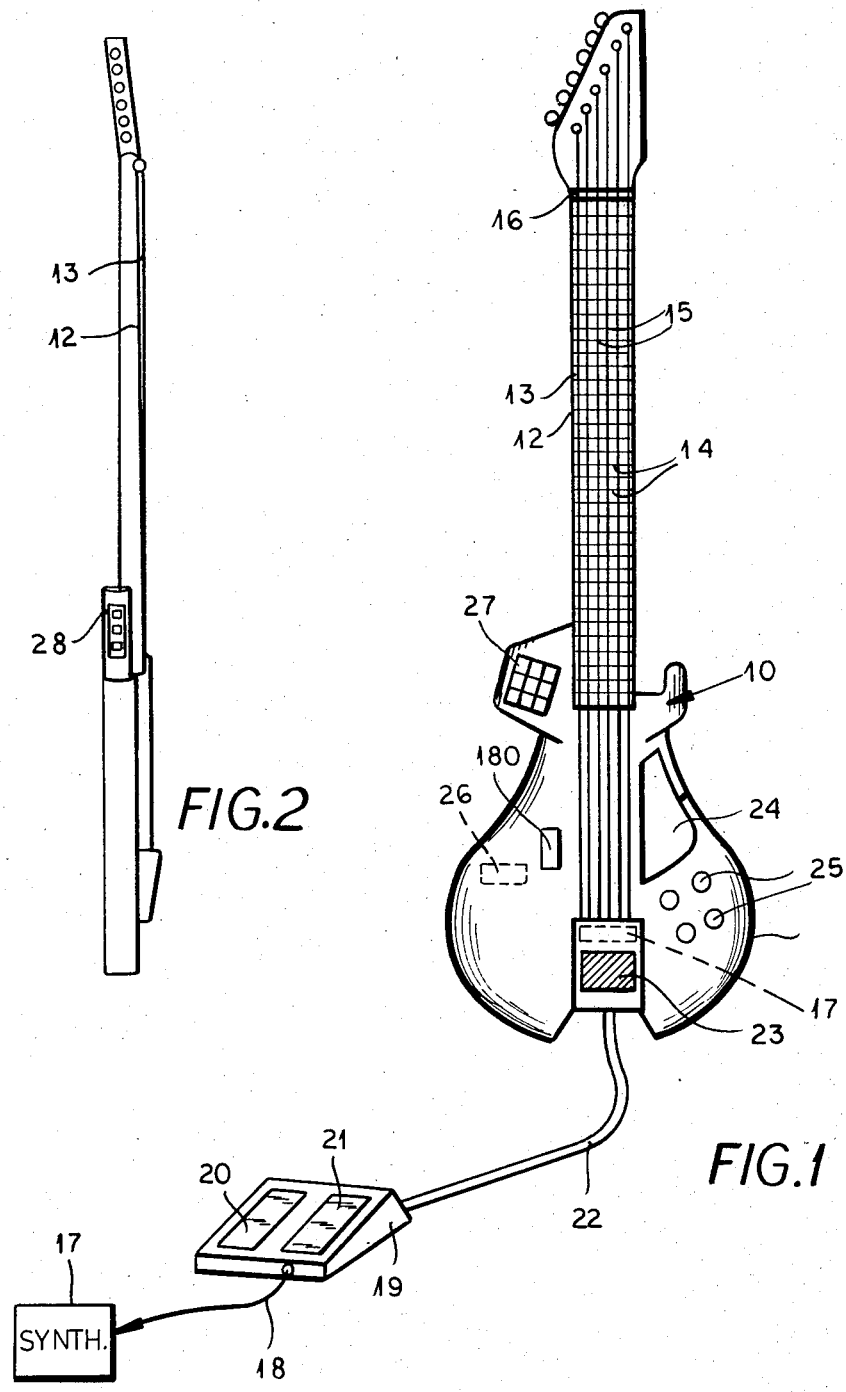
FIG. 1 is a diagrammatic elevational view of a guitar controller for a music synthesizer of the type described in my aforementioned patent and associated parts.
FIG. 2 is a side-elevational view of the guitar body.

In FIG. 1, a guitar 10 embodying the present invention can comprise a guitar body 11 which can have the configuration of any conventional electric guitar and has a neck 12 extending therefrom and formed with a fret board with a number of transversely spaced mutually parallel electrically conductive frets 14 overlain by an array of strings 15 of which six have been illustrated for a conventional 6-string guitar. For a bass, only four strings are provided.

The strings pass over or through a nut 16 and a bridge 17. A host electronic music synthesizer 17 is connected to the guitar controller as represented by the conductor 18 in highly diagrammatic form, in practice this being a 3-wire, coaxial cable as described in the aforementioned copending application, delivering the power ground and serial data transmission to the form of the guitar. In the embodiment illustrated, the synthesizer is connected to the guitar body through a pedal assembly 19 having a foot pedal 20 actuating the foot pedal controller and a fret switch 21 serving to turn on and off the connection with the synthesizer. A 3-wire cable 22, preferably a coaxial cable as described in my aforementioned patent, serves to connect the pedal assembly 19 with the guitar body 11 and carries the power, ground and data.

For the increase of orientation only, it is noted that the bend sensors are provided at the nut 16, that the string vibration sensors are provided at the bridge 17, that a heel sensor 23 for the heel of the strumming hand is mounted on a cover for the bridge, that a pickguard pressure sensor is located below the pickguard 24 and that programmable knobs 25 are likewise provided on the body and can be programmed by the synthesizer or any microprocessor connected thereto to control various synthesizer parameters when struck or pressed.

A body-strike sensor 26 is provided on or in the body to respond to the vibrations thereof induced by impact against the body. A key pad 27 for controlling the various functions can be provided for numerical or alphanumerical instructions including control of the programmable knobs 25, if desired, and a display 28 can be provided along an edge of the body visible to the player as represented in FIG. 2.

The housing of the assembly 19 can have a power supply independent of the synthesizer in which case only a 2-wire cable may be used to connect the assembly 19 with the synthesizer 17, and the microprocessor which controls the host synthesizer can be provided directly in the body of the guitar.

The key pad 27 can serve as a data entry device for entering the commands to the controlling microprocessor, which commands can include: assign MIDI channel; set controller sensitivities; set controller to various synthesizer parameters; and set fret switches, panel switch functions, panel knob functions and the like; and establish various synthesizer parameters to calibrate the instrument and call up a particular program number of the synthesizer.

The status of the instrument is indicated on the digital readout 28 which may be alphanumeric, as noted, or a standard 7-element-display.

Figure 3:
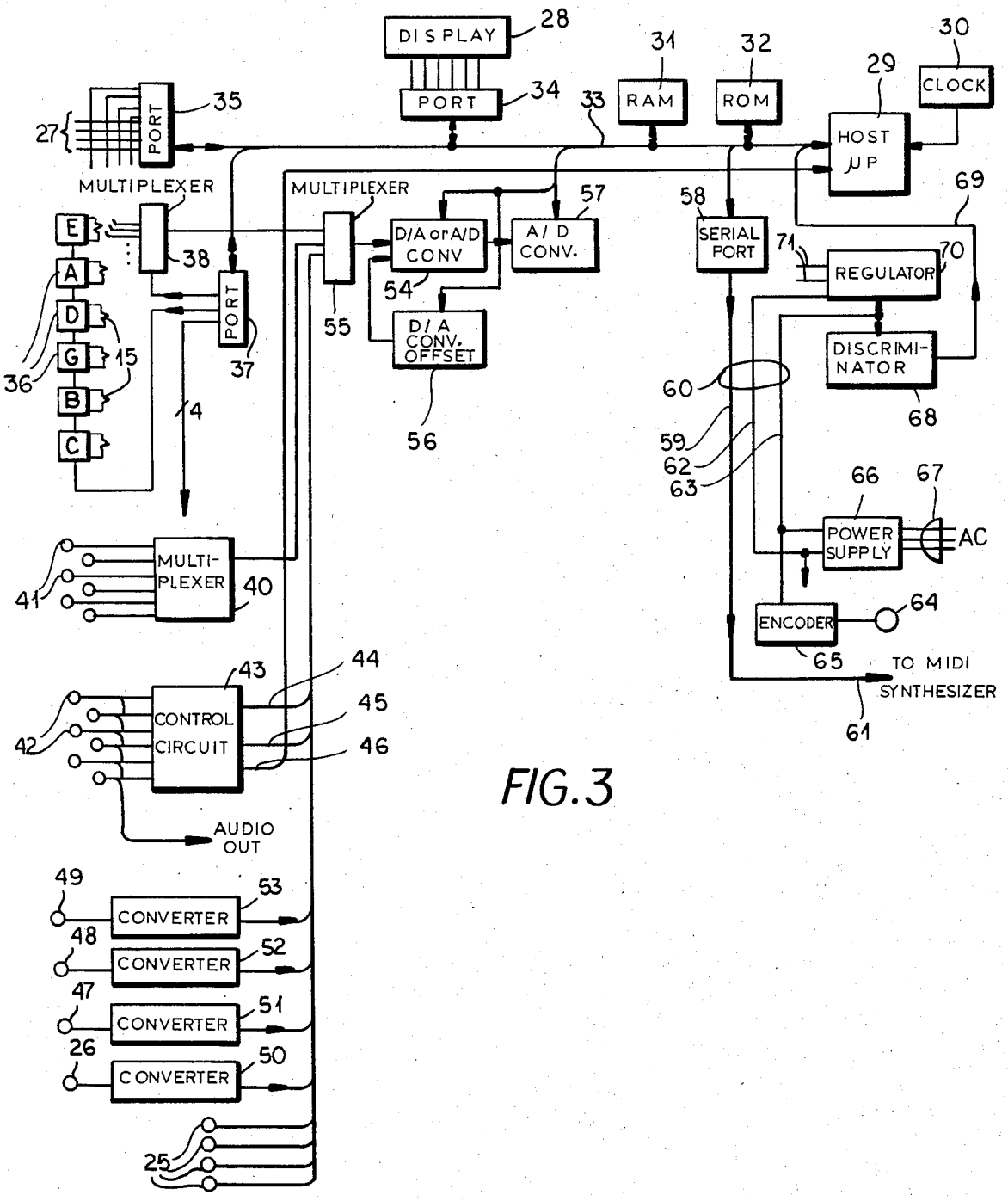
FIG. 3 is a system outline in block diagram form of the guitar controller.

FIG. 3 outlines some of these elements in block diagram form.

For example, in this Figure, the internal microprocessor of the guitar is seen to comprise a host-controller microprocessor 29 which can be provided with the usual clock 30, a random address memory 31 capable of storing data supplied by the key pad 27 and a read-only memory 32 having the requisite instruction sets for the microprocessor and preprogramming the microcomputer. These memories are provided along the data bus represented at 33. The display 28 is coupled to the data bus by a port 34 while the key pad is connected to the data bus by a port 35.

The individual string drivers are represented at 36 and the strings have been shown at 15.

The string drivers serve, as will be described below and as has been mentioned above, to pass a controlled electric current through each of the strings to establish the voltage gradient therealong (see description of fret acquisition system below) and includes the current source and a sink or drain controlled by a port 37 from the data bus 33 which also supplies the fret multiplexer 38.

A multiplexer 40 scans the bend sensors which have been represented at 41 and are provided for each string at the nut 16 while the string vibration sensors at the bridge have been represented at 42 and act into a control circuit 43 which is multiplexed at the host microprocessor with lines 44, 45 and 46 providing the control signal, the velocity signal and the interrupt signal as will be developed below.

Auxiliary controllers represented in this diagram include the body-strike sensor 26, a bridge pressure sensor 47, a pickguard sensor 48 and a neck pressure sensor 4*a* which are connected to the host microprocessor through respective converters 50, 51, 52 and 53. The control knobs 25 are also represented in this Figure and may be potentiometers connected to the host microprocessor.

As noted, the interface with the host microprocessor may interact with the data bus and include a programmable gain cell coupled with a programmable off-set to increase the effective measurement range.

In the system illustrated, a programmable digital-to-analog converter 54 can receive the measurements from the multiplexer 55 and can be connected with the programmable digital-to-analog converter offset 56, the output being applied to an analog-to-digital converter 57 connected to the data bus.

The data bus also works into a serial port 58, the output of which forms one conductor 59 of a 3-wire coaxial cable 60 connecting the guitar body to the pedal assembly. The latter conductor also runs as shown at 61 to a MIDI synthesizer. The other conductors of the 3-wire cable connecting the pedal assembly at the guitar body have been shown at 62 and 63 and represent ground and the clock-power lead, respectively.

The pedal transducer 64 which is operated by the pedal 20 is connected via the encoder 65 to the clock-power line 63.

The power to the latter derives from a power supply 66 connected to an alternating current source as represented at 67.

A discriminator 68 is used to separate out the power and clock signals and the pedal signal which is applied to the bus 33 as represented by the line 69. The regulator 70, in accordance with the principles of my aforementioned patent, output the system power at 71. The clock signals are applied to the microprocessor via line 29 as well.

B. Fret Acquisition System

As previously noted, my research into the use of a resistance bridge approach for detection of the fret closest to the bridge touched by each string results in long-term failure of the precision of the system even where special approaches are utilized to minimize contact resistance to the contact point between each string and the fret.

Such a system wherein load resistors are provided in series with the fret wherein the resistance of the string between the frets simultaneously contacted thereby are utilized, are highly sensitive to the contact resistance which, even if not present originally, inevitably develops, to manufacturing tolerance factors which make the fabrication of the system a practical impossibility in large numbers, and the like.

Various approaches have been used in the past to overcome this disadvantage.

For example, U.S. Pat. No. 4,372,187 utilizes a neck-scanning system which is similar in principle to a common computer keyboard scanner. Here the strings and frets form a matrix in which the strings represent columns and the frets represent rows. The columns are sequentially activated and any rows which are shorted at any columns to the string/fret contact points, are detected by a primary encoder whose output signals the row position. This system, however, has the disadvantage that ghosting can occur when several rows are shorted at many columns. The encoder can then react as if contact points existed which did not exist in reality.

A modification in U.S. Pat. No. 4,321,852 attempts to solve the problem by splitting the frets, thereby forming six switches of each fret-string matrix point. This unduly multiplies the complexity of the device and can react properly when the string is bent off-center which is a common guitar-playing technique.

*Electronotes Newsletter,* No. 52 of April 1975 (Guitar Controller for Synthesizers) and U.S. Pat. Nos. 3,530,227, 3,742,114, 3,332,877, 3,524,375 and 3,786,187 describe various resistance network approaches in an attempt to solve similar problems, a conductive pick playing a significant role.

I have now found that I can utilize a principle exploiting the guitar string as a conductor without the disadvantages enumerated.

Figure 4:
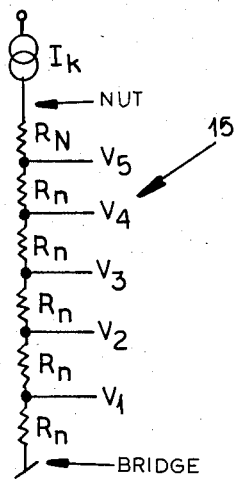
FIG. 4 is a diagram illustrating the guitar string as a resistive network for use in explaining the fret acquisition system of the invention.
Figure 5:
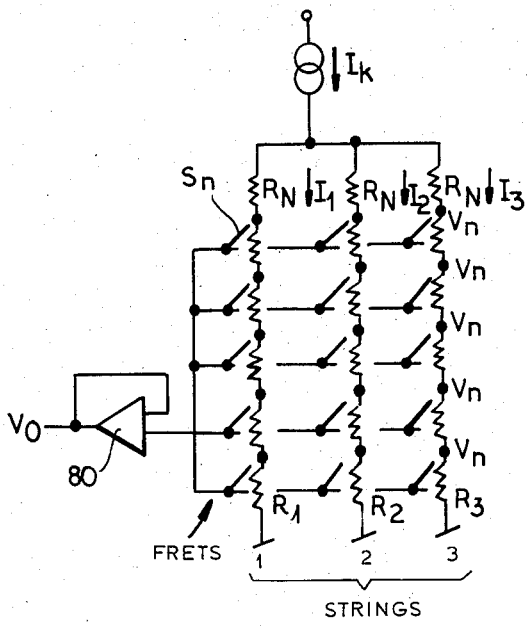
FIGS. 5–7, *7a, 7b, 7c* and FIG. 8 are circuit diagrams useful in understanding the fret acquisition system.

Referring to FIG. 4, one can see that each string 15 can be represented at a series of string segments each with a defined resistance $R_N$ or $R_n$ so that when an electric current is passed from a constant current source $I_k$ through this string to a sink at the bridge, at each point along the length of the string a voltage $V_1$–$V_5$ can be detected. Put otherwise, when a current is injected at each stage, a voltage gradient is created down the string and this gradient, on its level at any point, can be detected just as if the string was a resistive divider network. The taps of this divider network are the frets and, according to the invention, a high impedance buffer 80 can be provided to measure this voltage. By tapping off the different points on the resistive divider string with the high impedance buffer, a unique fret position can be determined for each string. Here the contact between each string (FIG. 5) is represented by a switch $S_n$.

Unlike other methods which utilize the string as a resistive divider, the high impedance buffer and multiplexing of the frets and strings practically eliminates the fret-to-string resistance $R_{fs}$ so that virtually no current passes from the string-to-fret for the sensing operation.

Figure 6:
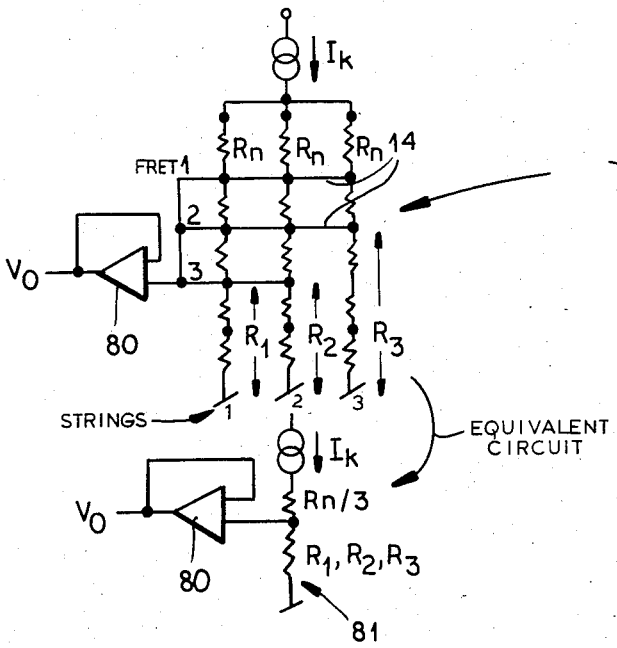
Figure 6:
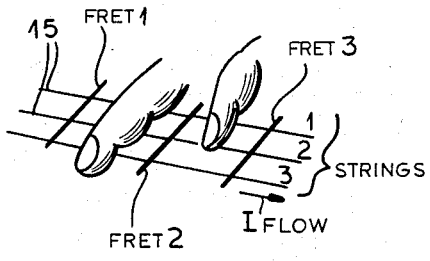
Figure 7:
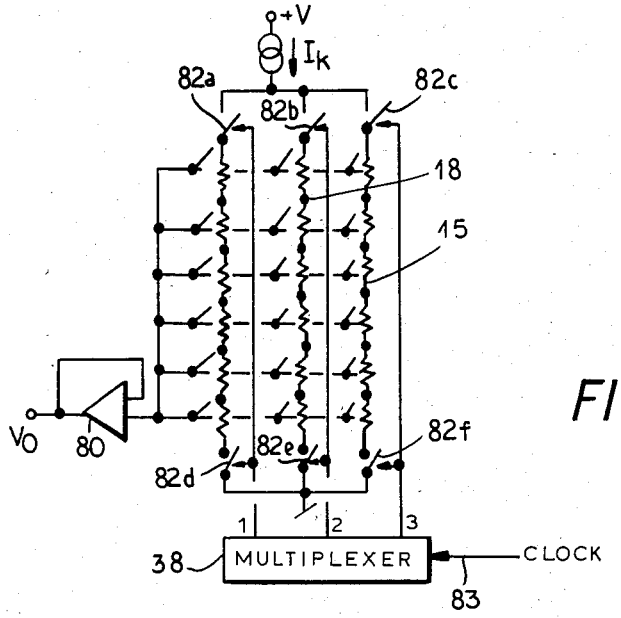

FIG. 6 is a diagram showing in effect what occurs when one utilizes a high impedance buffer 80 to detect the voltages at three frets 14, here referred to as frets 1, 2 and 3 upon the pressing of the string 15 (referred to as strings 1, 2 and 3). An equivalent circuit 81 represents the problem inasmuch as the remaining string resistances $R_1$, $R_2$, $R_3$ are in parallel with one another and the resistance $R_n$ between the constant current source $I_k$ and the buffer 80 is $Rn/_3$. It will be apparent that under these circumstances the buffer 80 is not effective to distinguish the voltages. For this reason the strings are multiplexed in the manner described (see also FIG. 7).

In FIG. 7 I have again shown a 3-string circuit, this time with six frets as an example. Customarily, the array of strings will be increased to the conventional number of strings in a guitar, say 6, and the frets to the customary number, say, 22. The multiplexing unit is here represented by a series of switches 82*a*, 82*b*, 82*c* between the constant current source $I_k$ and the strings 15 (here represented as divided resistances) while switches 82*d*, 82*e* and 82*f* are provided between the string and the drain, the strings being scanned to a clock frequency inputted at 83 to the multiplexer 38.

Figure 7A:
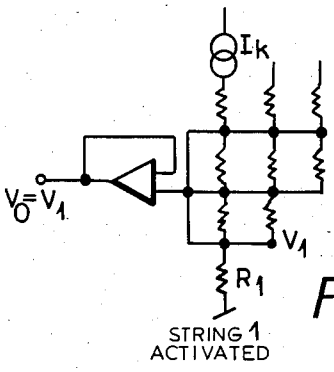
Figure 7B:
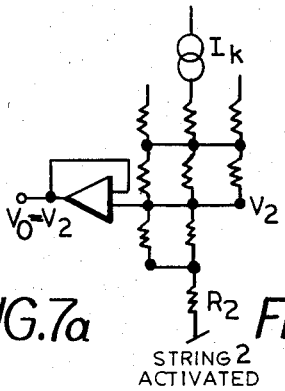
Figure 7C:
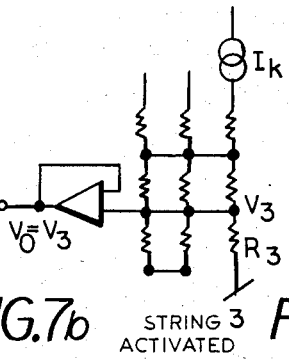

By multiplexing the string in this manner, when string 1 is activated, the equivalent circuit is that shown in FIG. 7*a* while when strings 2 and 3 are activated in addition, the equivalent circuits are those of FIG. 7*b* and 7*c*. Clearly, therefore, distinct voltages are obtained for each actuating mode.

In other words, by switching the current source and drain with the multiplexer previously mentioned, when one or more strings are depressed, only the scan string provides an output while the other strings float and do not affect the desired measurement through the string being scanned to ground.

Figure 8:
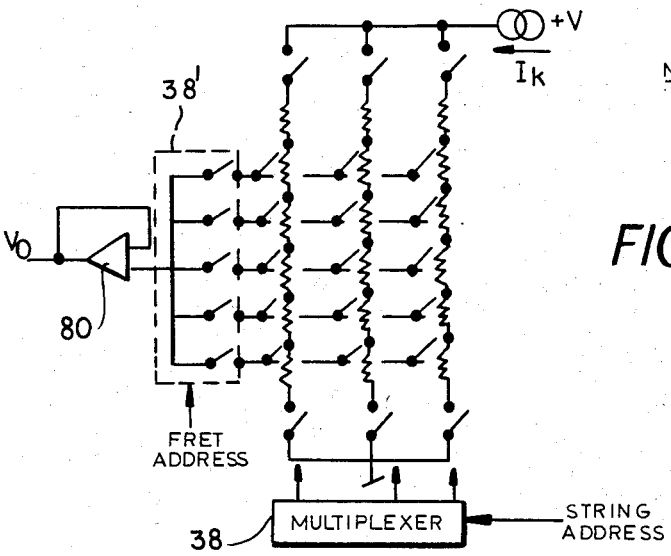

In the system of the invention, the fret-to-string resistance $R_{fs}$ plays no role because of the high impedance buffer used and because, as represented in FIG. 8, the frets may also be multiplexed to the high impedance buffer 80. The multiplexer 38, here supplied with the fret address from the microprocessor is clocked together with the string multiplexer 38 which has previously been described. This eliminates the cumulative of all contact resistances which may be present and which may add up to a substantial contact resistance with a noticeable voltage drop therethrough even with a high impedance buffer in some cases.

The frets are scanned in accordance with the invention from the lowest fret to the highest fret. When a voltage is sensed, the output buffer 80 will have found the key voltage and hence the key fret for the particular string being scanned, the result being a designation of the lowest fret engaged by a string depressed by the finger of the player. This information is transmitted to the synthesizer and is applied to the appropriate voice assigned to that string to generate the requisite tone.

The scan for the first string is stopped as soon as the lowest fret is detected and the frets are then scanned for string 2, the process being repeated for each of the strings and then recycled at string 1.

Note that the detection of each lowest fret is not effected by the other strings although they may be shorted at string 1 through other frets because no current is fed through them and the frets are not linked to a common connection to the buffer because of the multiplexing of the strings and the frets.

Advantageously, I may continue the scan upwardly past the lowest fret for which a voltage is detected to the next fret thereabove which should have a higher level of the measured value. When such a higher of the measured value is detected, this signals with certainty that the clear fret was the fret at which the previous measurement was taken. This is a majority rule scanning method that further eliminates any effects of Rfs.

Figure 9:
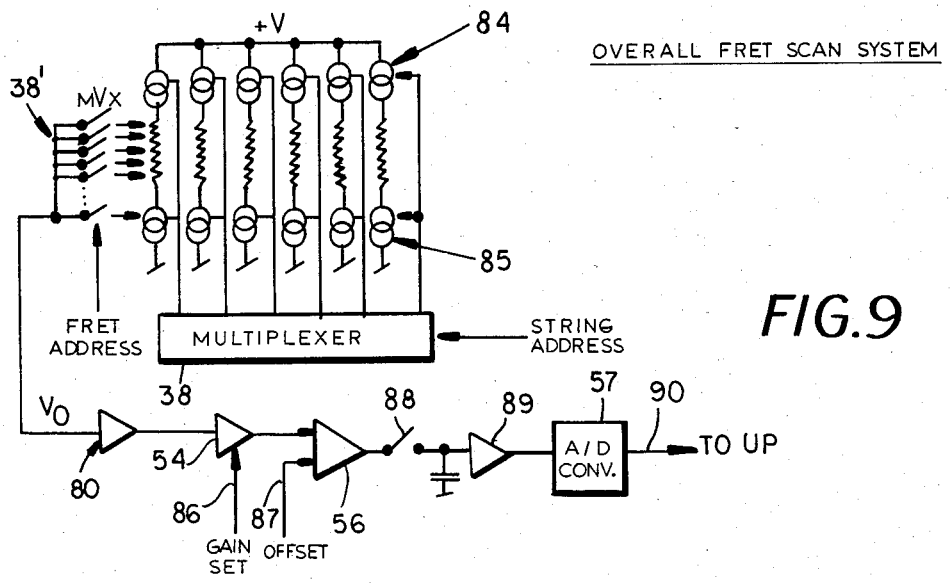
FIG. 9 is a block diagram of the latter system.

FIG. 9 shows the overall fret acquisition system which I prefer to use, this system comprising a respective switched constant current sources 84 which are successively rendered operational by the string multiplexer 38, the fret multiplexer being provided at 38'. The current sinks or drains 85 are likewise multiplexed by the string multiplexer and the multiplexed outputs from the frets are applied to the high impedance buffer 80.

Referring now to FIG. 3, it can be seen that ultimately this measured value can be applied to a programmable gain cell here represented as a digital-to-analog converter 54 whose gain can be set at 86 by a control from the bus 33. The offset may be applied as an input 87 from the bus 33 to an offset amplifier 56 which has also previously been described and the signal then delivered through a switch 88 also controlled by the microprocessor to a buffer 89 and the analog-to-digital converter 57 which is connected as shown at 90 to the microprocessor 29, e.g. via the data bus 33.

Figure 10:
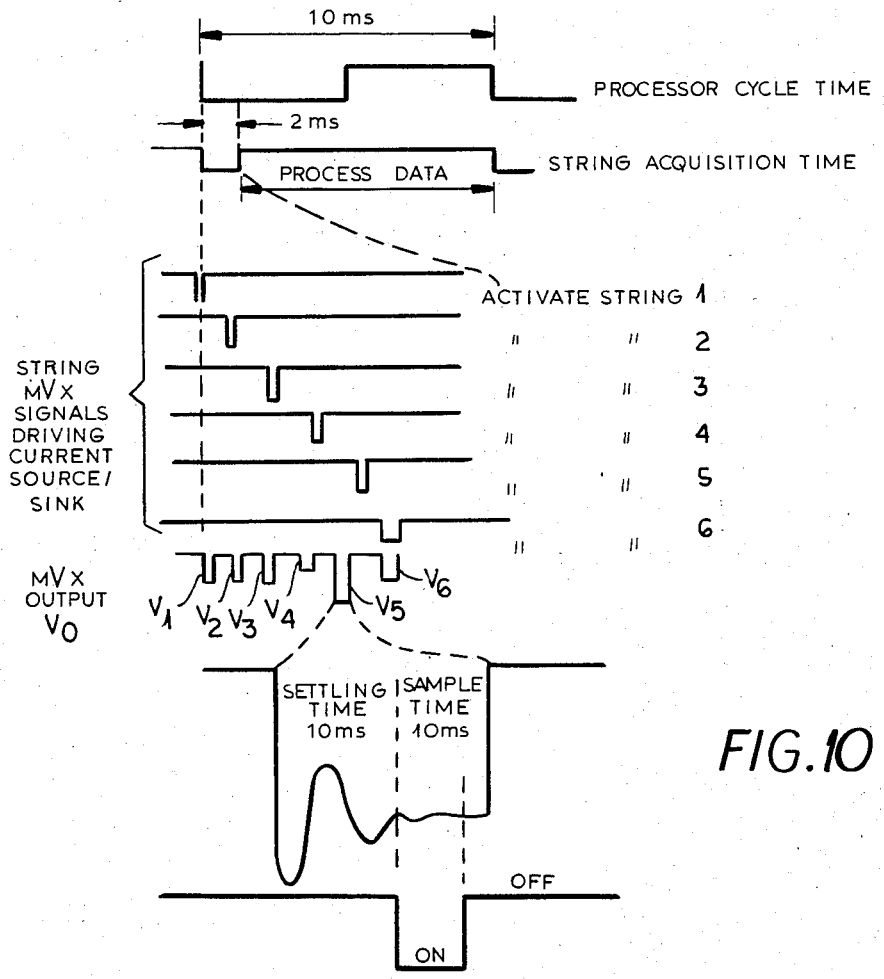
FIG. 10 is a timing diagram of the operation thereof.

FIG. 10 is a timing diagram showing the multiplexing of the current sources and sinks.

The resistance of the average guitar string is generally between about 1 to 8 ohms and depends upon the gauge of the string and the material used. Similar gauge strings have higher resistances. Only about $\frac{3}{4}$ of the string length lies along the fret board in the neck so that the sensing length is even smaller than the total length of the string. If, for the sake of discussion, it is assumed that the sensing length is broken up into 22 equal divisions being equally spaced frets, the value of $R_n$ is about 0.75/22 or about 30 milliohms for a string having a resistance of 1 ohm.

For maximum sensitivity of the measuring circuit, the voltage drop should not be less than 2 mV between frets since values less than this are difficult to measure and the measurement may be effected by noise and operational amplifier offset errors. In a worst case scenario for a 1 ohm string, therefore, it is necessary to inject a current of about 1 ampere to obtain a voltage drop of about 30 mV between frets. As noted, the output of the buffer amplifier is applied to the digitally controlled amplifier or digital-to-analog circuit 54 which is controlled by the host microprocessor 29. Each string is calibrated by the microprocessor by sensing the lowest voltage and the highest fret voltage, corresponding to the frets nearest and furthest from the bridge. From this, the full sweep of the string is analyzed, typically from 0.5 volts to 2.5 volts and a gain setting for the string is stored. Also, since the lowest fret voltage will not be on because of the drop across of the resistance remaining at the bridge, a digitally controlled offset is also injected to the digitally controlled amplifier to convert the lowest voltage to 0 volts. When the string is activated, the computer sets the DCA at the calibration gain and offset to maximize the measured value and thereby increase the sensitivity.

Since practically no current flows through the contact points, there is no arcing or fret wear due to switching currents. Because the current source which drives the string is part of a current sink (low impedance)/current drain combination, there is no danger of current flow through the player bypassing the current drain at an external ground.

As the timing diagram 10 shows, the current sources and sinks are multiplexed with an interval of about 2 milliseconds, since it is desirable to process the acquired data within 10 milliseconds to minimize the delay time from string activation to synthesizer sound. I have found that the remaining 8 milliseconds is sufficient computing time to process the information for transmission to the synthesizer.

To minimize the required current and heating buildup, the current sources and sinks are only enabled for a short time during the scan cycle. In practice this duration suffices if it is about 20 microseconds for a duty time for each string of about 1%. For six strings, the total duty cycle is 6% so that only 6% of 1 ampere averaged out over the string or 60 mA is sufficient to drive all of the strings.

C. String Vibration Sensor

In the past, the most popular method of sensing string vibration for electric guitars has been the variable reluctance pickup which utilizes a coil wound around a magnet whose magnetic field is intercepted by the vibrating string. The vibration of the string induces an electric current in the coil and this current is provided as electrical signals corresponding to the guitar sound. This does not allow a high degree of separation between strings. As a consequence, most guitar pickups utilize a common magnet and generate an output representing the sum of string vibrations.

In an article entitled *Hall Effect Pickup for Stringed Musical Instruments,* published November 1978 by the Audio Engineering Society and written by Iodice, a linear Hall effect integrated circuit is substituted in a pickup of the variable reluctance line for a coil responding to a change in the magnetic field. This system also shows limited isolation or separation.

Electronic Engineering December 1974 contains a design article entitled *Photoelectric Vibration Probe for Stringed Instruments* which describes the use of a reflective photoemitter/detector pair to sense the vibration of a string in the August 1977 issue of Musician's Guide, an article by Gill entitled *The Dawn of Light Technology,* describes a guitar pickup using photointerrupters to provide independent audio outputs. The latter systems, therefore, can isolate the individual strings.

The string vibration sensor of the present invention extends further the individual string sensing systems of these latter two publications.

Figure 11:
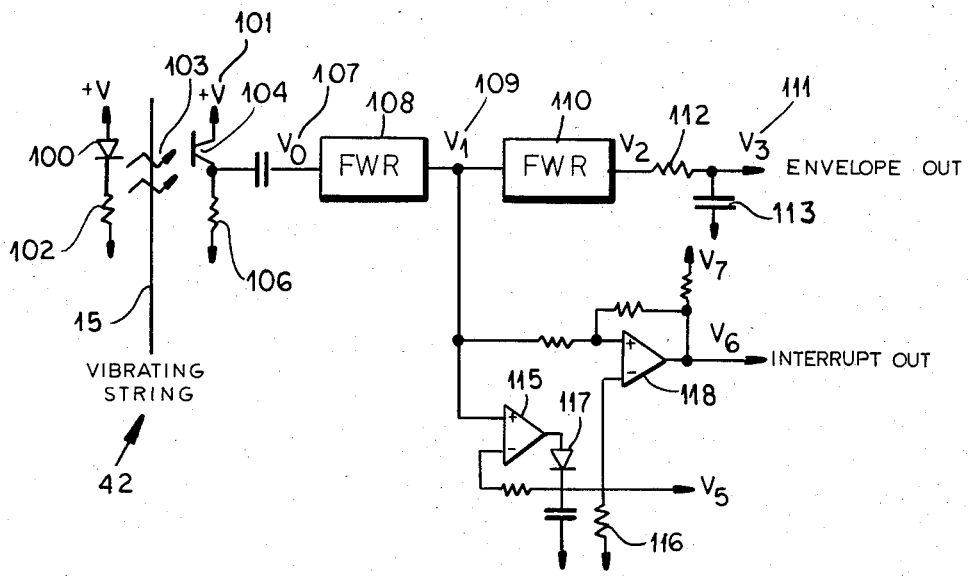
FIG. 11 is a block diagram of a string vibration sensor according to the invention.

Specifically, FIG. 11 illustrates a complete vibration sensor for a signal string, six such sensors being provided for a conventional guitar while four such sensors may be provided for four strings of a bass guitar The outputs may, of course, be multiplexed at the data bus as previously described Here the vibration string is shown at 15. The unit is contained in a housing at the bridge and the entire sensor has been represented at 42 as in FIG. 3.

The opto-interrupter or flow-interrupter module comprises a photoemitter in the form of a diode 100, shown to be in series with a power source 101 and a resistor 102. The light rays 103 are intercepted by the vibrating string 15 and the past light is detected by a photodetector 104 linked to the power source 101 and to ground and provided in circuit with biasing resistors 105 and 106. According to the invention, the signals from the individual optical interrupter modules are used to drive independent string vibration control signals by a unique envelope detection circuit that drives the signals necessary for the generation of a gate and velocity signals.

The output $V_0$ of each photodetector is applied at 107 to a full-wave rectifier (FWR) 108 whose output voltage $V_1$ is applied at 109 to the full-wave rectifier 110 which outputs the envelope signal $V_3$ at 111 through a resistor 112 and across a capacitor 113. The envelope output is applied as the signal 44 to the multiplexer and by the latter to the data bus with programmed gain control as previously described.

The output of the full-wave rectifier 108 is applied to a high slew rate operational amplifier 115 provided with a peak detector network 116 outputting at $V_5$ the peak which is applied as the velocity output at line 45 in FIG. 3. The interrupt output is derived by detecting V6 across a diode 117 and is outputted at $V_7$ to the line 46 of the circuit as shown in FIG. 3 via the operational amplifier inverter 118.

The digitally synchronized modulation/demodulation system described below with respect to the string bend sensor may also be used to eliminate the effect of ambient fluorescent lighting or like lighting effects.

Figure 12:
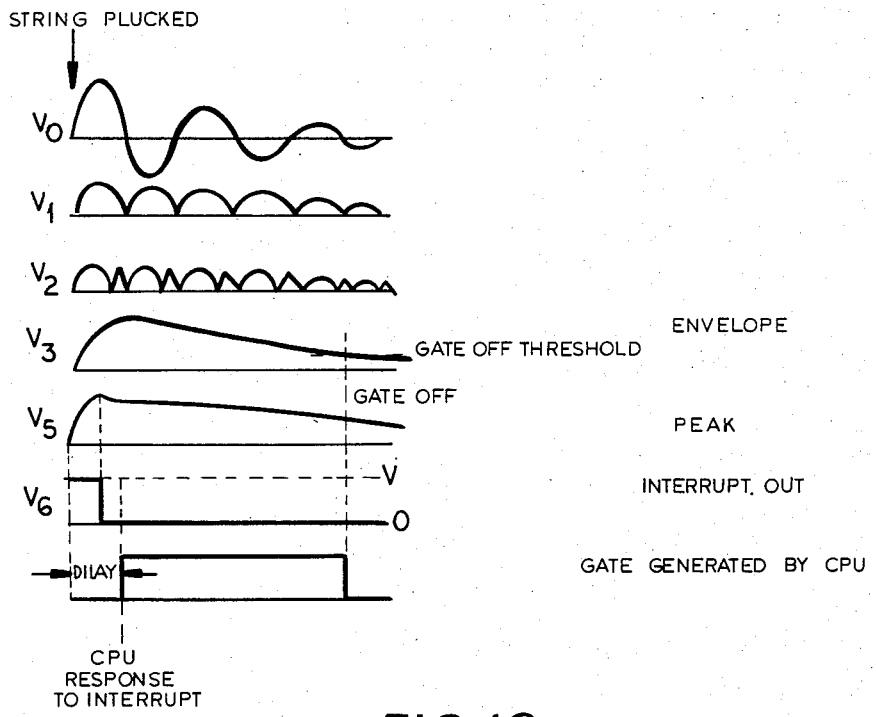
FIG. 12 is a wave-form diagram illustrating the operation thereof.

As can be seen from the voltage/time diagram of FIG. 12, the flow-interrupter module is normally in a low light state since the string rests in the optical axis. When the string is picked and thus vibrated, the string motion interrupts the light path and amplitude modulated by the transmitted beam. This modulation is sensed by the optical detector and transformed into the signal $V_0$.

The FWR 108 converts this bipolar signal into a unipolar signal $V_1$ of twice the frequency. A second FWR multiplies this signal by two again so that the resulting signal $V_2$ has four times as many peaks as the original signal $V_0$.

Capacitor 113 acts as a filtering capacitor which smoothes the rectified signals $V_2$ to provide the smooth signal $V_3$ representing the envelope which can cut off the gate at the gate off-threshold as noted.

The envelope has a lagged attack and decay because of the presence of the filtering band capacitor 113 and thus it is unsuitable for sensing velocity and serving as a gate-on signal, even if it is perfectly fine for use as a decaying gate-off signal. The use of two cascaded FWRs as shown in FIG. 11 allows the capacitance of condenser 115 to be much smaller than if only one FWR were to be used.

The envelope output is, as noted, fed to the microprocessor via the variable gate-offset circuit described in detail with respect to the fret-acquisition system and is multiplexed to the data line 33 (FIG. 3) as described with respect to the latter Figure. The analog-to-digital converter of the variable gate-offset converts the envelope to digital form. To increase the on-time of the envelope to its maximum value, the gain is increased as the processor measures successively decreasing voltages so that the system effectively forms a digital automatic gain control (AGC). When the processor cannot increase the gain to a point that the input is greater than the off-threshold, the gate is turned off. Consequently, this system maximizes the ability to exploit the vibration of the string for the greatest possible duration.

The amplifier 115 and the peak detector 118 represent circuits tapped off from the first FWR stage 108. These circuits generate a microprocessor service interrupt signal when the maximum peak is reached.

The peak value of the differentiator output is stored by the peak detector and is fed to the processor via the ADC input for conversion into the velocity signal and the gate-on signal.

The output of the peak detector amplifier 115 will change state at the time the peak is acquired so that the state is fed to the microprocessor interrupt input and so that the microprocessor need not service strings that either are not yet plucked or have been plucked but have not yet reached their peak.

This saves a substantial amount of computing time over poling systems widely in use. This will be appreciated by understanding that without this system the microprocessor must consequently check each string to see what state it is in. If the sampling period is too short, then processing time will suffer. If it is too long, a peak may be missed. This detection system, therefore, provides first velocity detection, a substantially perfect gate-off sensing method and an interrupt servicing scheme which cuts the processor use to a minimum.

Figure 13:
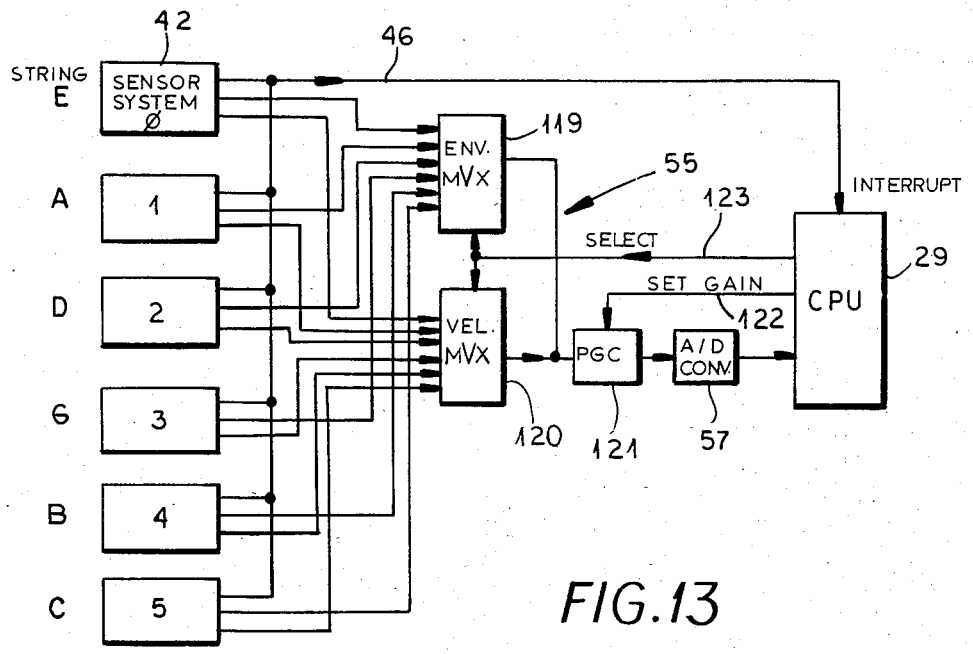
FIG. 13 is a block diagram of the entire string vibration system.

The diagram of FIG. 13 illustrates the multiplexing principle which is used. Each of the sensor units 42 for the six strings of a guitar can deliver the interrupt via the line 46 directly to the CPU 29, i.e. independently of the multiplexing system 55 previously described. The multiplexing system 55, however, can have an envelope multiplexer represented at 119 and a velocity multiplexer 120. In the latter case, both multiplexers work into the programmable gain control 121 represented by elements 54 and 56, and then into the analog-to-digital converter 57 feeding the microprocessor data input.

While the microprocessor in FIG. 3 has not been shown to provide its address and instruction signals on the bidirectional data bus, it will be apparent that one of the outputs of the microprocessor is a set gain signal 122 which is applied to the programmable gain controller 121 while another output is a select signal 123 which enables one or the other multivibrators 119, 120.

Figure 14:
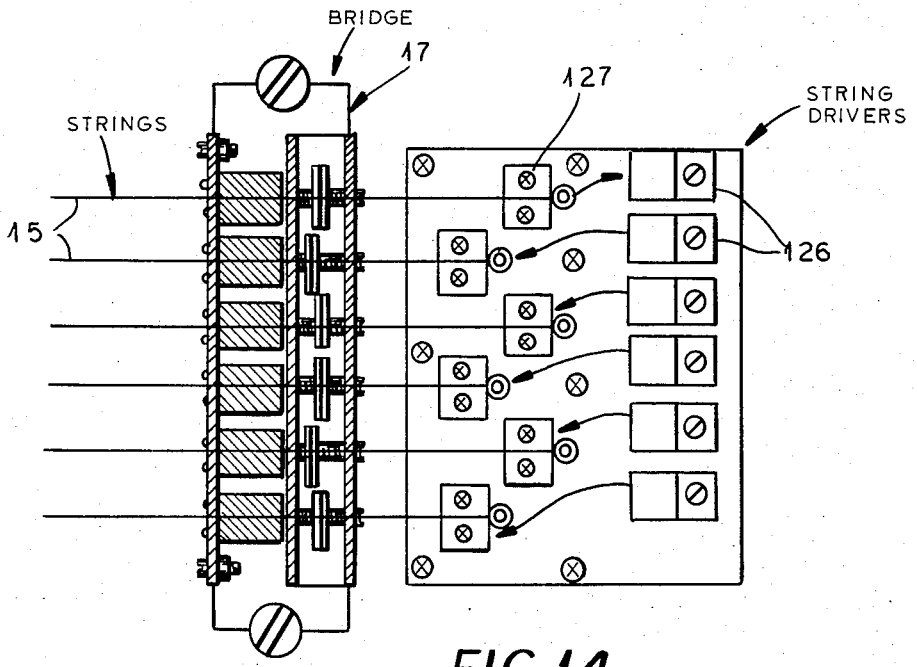
FIG. 14 is a plan view, partly broken away, illustrating the use of photointerrupters in the latter system.

FIG. 14 is a diagrammatic plan view, partly broken away and with the cover removed, in the region of the bridge of the guitar shown in FIG. 1.

Figure 15:
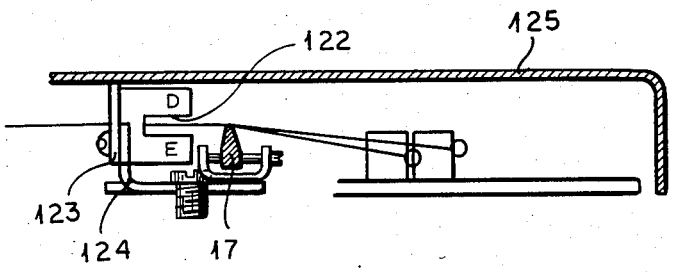
FIG. 15 is a cross-sectional view taken in a longitudinal plane of the guitar through the structure shown in FIG. 14 but with the cover in place.

FIG. 15 represents the bridge in cross section and thus is a section through FIG. 14 with the cover being shown in place.

Here again the strings have been shown at 15. The bridge is generally represented at 17 and is provided with the opto-interrupter forming part of the string vibration sensors in a particular manner.

The optical interrupters are prone to interference from ambient light which may saturate the detector or add a 60 cycle hum if the system is used in fluorescent lighting.

Below I have described an electronic approach to eliminating the ambient light problem and while I prefer to use this approach, I may also exclude ambient light to the greatest possible extent.

To this end, the individual optical interrupter modules are turned so that their open ends 122 are directed toward the bridge 17 and are mounted on a support body 123 in the form of a plate bolted to a bracket 124. A hole is provided in the support 123 along each optical axis through which the respective string is threaded through the point of maximum sensitivity without the need to calibrate the position of the sensor after manufacture because the bridge always will be able to correct the position of the string.

A cover 125 is placed over the entire assembly to shield the detectors from ambient light.

FIG. 14 also shows the string dividers 126 which have been mentioned previously with respect to the fret acquisition system, the string dividers being connected at conductive blocks 127 against which the strings are secured, the conductive blocks being provided with conductive paste to ensure good electrical contact.

D. String Bend Sensors

As noted previously, string bend sensors have been provided heretofore in various formats and constructions in U.S. Pat. No. 4,372,187, for example, critically positioned potentiometers since the increased tension played upon a string which is bent off-axis from its natural position. A similar technique is used in U.S. Pat. No. 4,306,480. Strain guages have been employed as well as mechanical movement sensors.

In all cases of which I am aware, string bend detectors or sensors can be mechanically located to the string.

The string bend sensors utilized in accordance with the present invention are contact-less sensors located at the nut. These sensors have been designated at 41 in FIG. 3 and will be so designated in the Figures discussed below.

Figure 16:
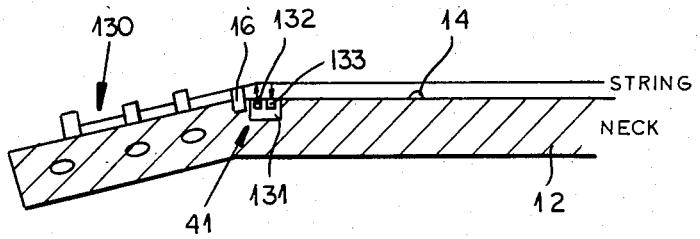
FIG. 16 is a similar construction through diagrammatic cross section taken longitudinally through the neck of the guitar illustrating a rectifier string bend sensor.

For example, in FIG. 16 I have shown a diagrammatic cross section through the neck 12 of a guitar in accordance with the invention in which the nut 16 has been shown in greater detail and the screws for tightening the strings have only been shown diagrammatically as the machine 130. Here the sensors are reflective sensors. Similar sensors can be used as the string vibration sensors as well. More particularly, each sensor 41 can include a module 131 containing a photoemitter 132 and a photodetector 133, the emitter/detector pair being placed directly beneath each string so that in the natural position maximum light is reflected. Note that because the module 131 is placed at the nut 16, there is little string vibration although the string is substantially bent off-axis when the finger of the player bears against this string.

When the string is bent, less light will be reflected so that the detector output will decrease in direct proportion of the amount of string bending.

Figure 17:
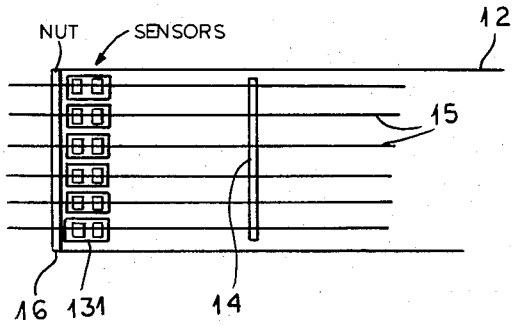
FIG. 17 is a plan view of a portion of the latter guitar at the nut thereof.

FIG. 17 shows that these modules 131 are disposed beneath each string 15 proximal to the nut 16.

A drawback of this system is its sensitivity to ambient light.

Figure 18:
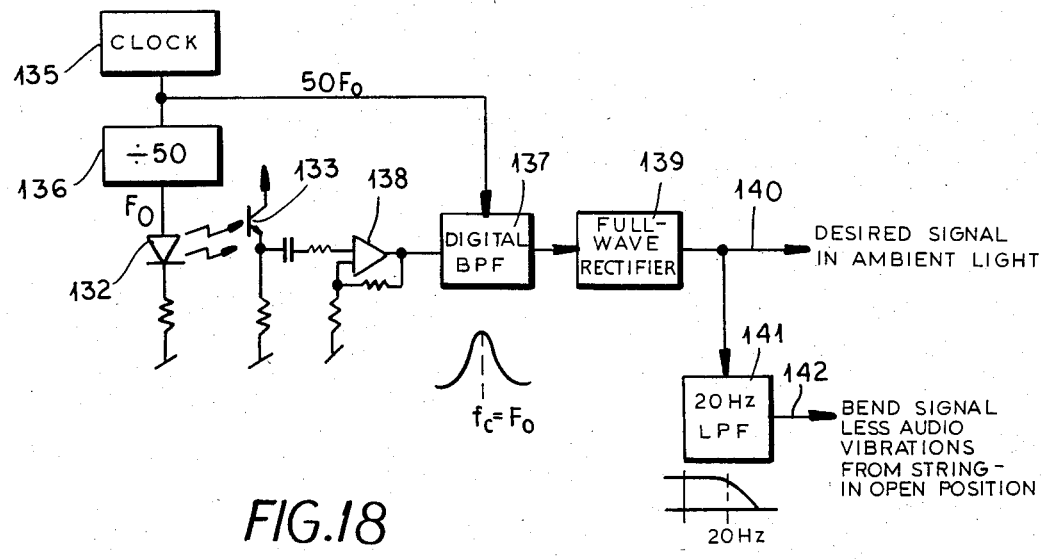
FIG. 18 is a block diagram of an ambient light, the circuitry used for eliminating the ambient light effect.

Obviously a cover can be provided here as well to eliminate the ambient light sensitivity. However, I prefer to utilize a digitally synchronized modulation/-demodulation approach as shown in FIG. 18.

In this case, the emitter is a modulated infrared beam. When such emitter 132 has been shown in FIG. 18 in series with a clock 134 and a divider 136 which divides the clock frequency by 50.

A narrow band filter 137 is in circuit with the amplifier 138 of the detector 133 and has its center frequency approximately equal to the modulation frequency of the detector. Coupled with an infrared filter to eliminate DC offsets, this system will effectively eliminate any ambient light effects and allow accurate string bend sensing.

The tendency of the center frequency to drift is overcome by utilizing a switched capacitor band pass filter 137 to the detector output. These filters have digitally controlled center frequencies that are typically one fiftieth of the contacting frequency. Here the contacting frequency applied to the band pass filter from the contact 135 is 50 times $F_0$, the modulation frequency.

The emitter is passed to the frequency $F_0$ and the filter clock input at the digital band pass filter 137 is passed at a rate pf 50 $F_0$ so that the emission and detection are perfectly tuned at all times and do not require calibration. One of the possible disadvantages of this system is that the reflective sensor may respond to increase the output because of increased reflection by fretting a string core to the nut even though the string is not bent. However, since strings bends can only decrease the output, any increases can be rejected so that accuracy of string bend sensing will not be adversely affected.

The output of the digital band pass filter 137 is applied to a full-wave rectifier 139, the output 140 of which represents the desired signal even in the presence of the ambient light and can be multiplexed at 40 to the bus 33. If one wishes to obtain the bend signal less audio vibration from the strings, a 20 Hz low-pass filter 141 is connected to the full-wave rectifier 139 to output the bend signal at 142 which is processed as described.

Figure 19:
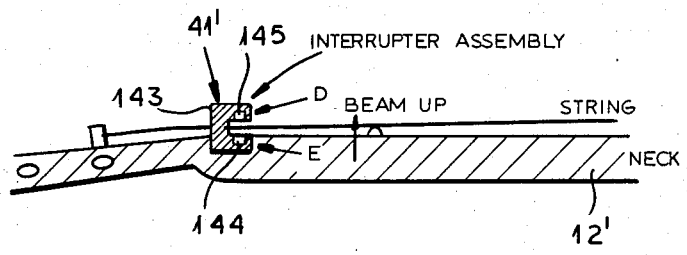
FIG. 19 is a section similar to FIG. 16 illustrating another embodiment of the string bend sensor.

FIG. 19 is a diagrammatic section through a guitar neck 12' which utilizes an interrupter assembly 41' as the string bend sensors and simultaneously as the nut.

In this case, the assembly comprises a support 143 pierced with holes 144 along the optical axis through which the strings are threaded with the arms of the assembly straddling the strings being provided with a photoemitter 144 and a photodetector 145 for each string. Upon bending of the string, the string moves to an off-axial position.

Figure 20:
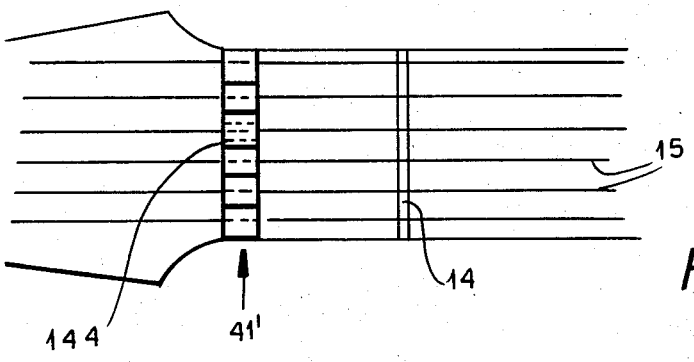
FIG. 20 is a plan view of a portion of a guitar embodying this sensor.

In FIG. 20, while the reflective sensor arrangement has the problem that no mechanical adjustments are usually available to vary the position of the string axis to the nut so that the reflective system must rely on accurate positions of the reflective sensors in the neck. By drilling a hole in the base of the module and threading the string through the hole practically in line with the interrupter beam, an assembly of six interrupters 41 can replace the nut piece together and accurately position each string with respect to the photo-interrupter. Also by providing the detector at the top of the assembly, ambient light effects are minimized to the point that the circuit of FIG. 18 may not be necessary, although it is preferably used here.

To avoid spurious signals, the multiplexing of the string bend sensors is controlled by the microprocessor so that a string determined to be unfretted by the fret acquisition system has its string bend sensor ignored because obviously that string cannot be bent off-axis.

E. Auxiliary Controllers

Figure 21:
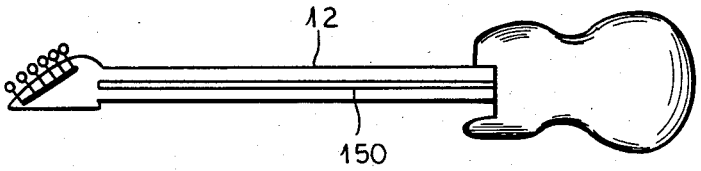
FIG. 21 is a diagrammatic rear view of a guitar provided with a neck pressure sensor according to the invention in one embodiment thereof.

In FIG. 21 I have shown the rear view of a guitar which is provided with a neck pressure sensor 150 along the neck 12. This neck pressure sensor (see FIG. 22) can comprise an optical fiber 151 which is connected between a photoemitter 152 and a photodetector 153 extending along the length of the guitar neck. One surface of the guitar neck is provided with an undulating patterns 154 and is juxtaposed by a complementary undulating or corrugated flexible member 155 (see my aforementioned copending application) such that, with compression by the hand of the player, the optical fiber is distorted to change the transmissivity of the optical fiber and thus provide an expression output which is multiplexed under the control of the microprocessor to the synthesizer as described. The assembly shown in FIG. 22 may also be used as the fret guard pressure sensor. The body-strike transducer may be a piezo-electric crystal which is distorted upon impact.

Figure 22:
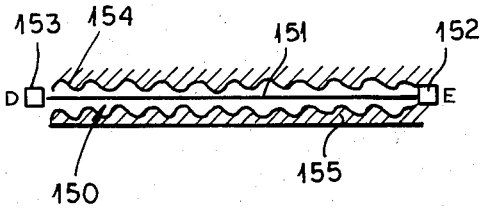
FIG. 22 is a diagrammatic section illustrating the sensor in greater detail.
Figure 23:
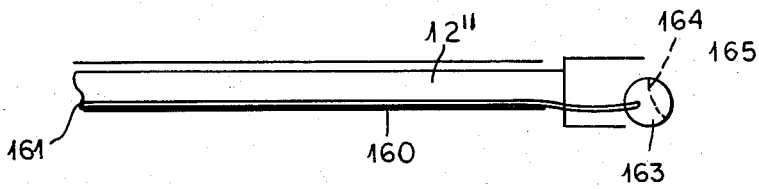
FIG. 23 is a diagrammatic side view showing another embodiment of the neck pressure sensor.

As an alternative for the optical fiber sensor of FIG. 22, the underside of the neck 12" of the guitar may be formed with a tube 160 sealed at one end 161 and extending the full length of the neck or at least a central portion thereof (FIG. 23).

The tube can act upon a chamber 163 containing a diaphragm 164 which moves as the tube is compressed by the hand of the player. A photodetector/emitter module of the type previously described in connection with FIG. 16, for example, can be provided at 165 to direct a light beam upon a reflective surface of this diaphragm while the light intensity detected by the detector will represent the output.

Figure 24:
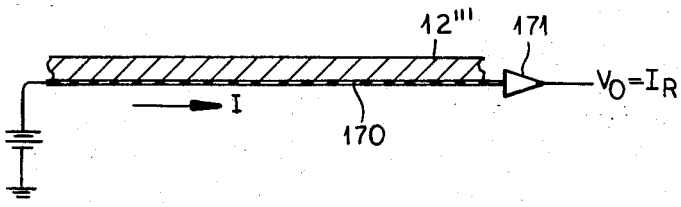
FIG. 24 is still another diagram of a neck pressure sensor.

In my aforementioned copending application, moreover, I describe the use of a conductive rubber sensor and this may be employed here too. As shown in FIG. 24, a strip of conductive rubber 170 can be provided along the neck 12"' of the guitar, preferably at the underside thereof and can be connected via an amplifier 171 to the multiplexer.

Figure 25:
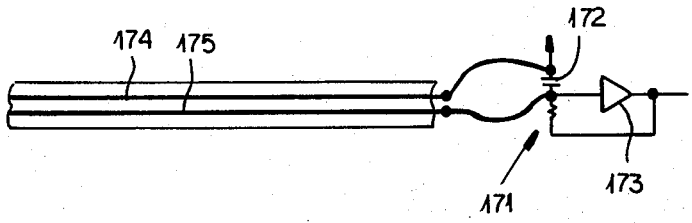
FIG. 25 is a rear view of the neck of a guitar with yet a further neck pressure sensor.
Figure 26:
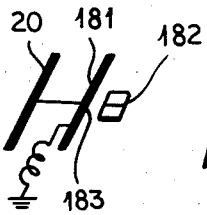
FIG. 26 is a diagram illustrating the principles of operation of the foot pedal sensor.

Another neck pressure sensor has been shown in FIG. 25 which utilizes a capacitance change detection circuit 171. Across the capacitor 172 of this circuit is provided an operational amplifier 173 to measure the capacitance. The terminals of the capacitor are connected at respective conductive strips 174, 175 extending along the back of the neck of the guitar and in spaced apart relationship so that as the figures or hand of the player contact these strips, the effective capacitance of the capacitor 172 will change and provide the desired output. The heel sensor 23 and the thumb sensor 180 may also be of the type described in FIG. 22 or of the capacitive type utilizing wires, strips or plates as described in connection with FIG. 25. The pedal 20 of the foot pedal assembly 19 (FIG. 26) may be connected to a movable member 181 juxtaposed with a photoemitter/detector module 182 of the type previously described so that the movement of the reflective surface 183 may be measured.

The expression devices described in my aforementioned copending application and earlier patents may, of course, also be used here.

I claim:

1. A method of detecting note selection in a guitar having a plurality of frets spaced apart along a neck of said guitar and a plurality of guitar strings extending along said neck over said frets, said method comprising the steps of:

(a) passing an electric current through each of said strings whereby a voltage gradient is established along each string at least in a region thereof overlying said frets;

(b) measuring a continuous voltage, from a high value representing last of said frets being selected and a low value representing none of sid frets being selected, forming part of said gradient of each string upon the depression thereof into contact with a respective fret without drawing significant electric current through the point of contact or deterring substantially said gradient, thereby determining a free tone-generating length of the respective string; and (c) controlling a music synthesizer to generate a corresponding tone in accordance with the measured voltage.

2. In a guitar controller for a music synthesizer having a guitar body, a neck extending from said body, an array of transversely spaced mutually parallel electrically conductive guitar strings extending along said neck from a nut at an upper end thereof to a bridge on said body, and a multiplicity of electrically conductive frets extending in transversely spaced relationship across said array of strings on said neck and below said strings, whereby said strings are depressed against said frets for note selection, the improvement which comprises in combination:

means for passing an electric current through each of said strings at least in a region in which said strings overlie said frets whereby a voltage gradient is established along each string;

means including at least one high impedance buffer connected to said frets for measuring a continuous voltage, from a high value representing last of said frets being selected and a low value representing none of said frets being selected, forming part of said gradient of each string upon the depression thereof into contact with a respective fret without drawing significant electric current through the point of contact of altering substantially the gradient along the respective string, thereby determining a free tone-generating length of the respective string; and means connected to said measuring means for controlling a music synthesizer to generate a corresponding tone in accordance with the measured voltage.

3. The improvement defined in claim 2 wherein said measuring means includes a multiplexer connected between said buffer and said frets for multiplexing said frets to said buffer.

4. The improvement defined in claim 2 wherein said means for passing said electric current through eawch of said strings includes a multiplexer and a constant current source and a current sink jointly multiplexed by said multiplexer to each of said strings in turn.

5. The improvement defined in claim 2 wherein said measuring means includes means for cyclically scanning the frets for each string from the fret closest to said body to the fret closest to said nut and responding to the first fret in each cycle having a voltage thereon.

6. The improvement defined in claim 2, further comprising a programmable gain cell connected to said measuring means and operable by a microprocessor for increasing the measurement sensitivity.

7. The improvement defined in claim 2, further comprising a string vibration sensor responsive to vibratory deflection of each string for defining for said synthesizer the inception and termination of the corresponding tone, each string vibration sensor including a photoelectric emitter-detector pair straddling a respective string and forming a photointerrupter, means for determining a slope of a signal generated by said photointerrupter to establish the inception of the corresponding tone and an automatic gain control for said photointerrupters increasing the gain of a signal outputted thereby as the outputted signal falls with time to maximize the duration of the corresponding tone to termination.

8. The improvement defined in claim 7 wherein each string vibration sensor includes a photoelectric emitter-detector pair straddling a respective string and forming a photointerrupter, means for determining a slope of a signal generated by said photointerrupter to establish the inception of the corresponding tone and an automatic gain control for said photointerrupters increasing the gain of a signal outputted thereby as the outputted signal falls with time to maximize the duration of the corresponding tone to termination.

9. The improvement defined in claim 7 wherein said string vibration sensor includes a photoelectric emitter-detector pair straddling each string and received in a housing formed on said body, said pairs being disposed in a plane perpendicular to said body, said housing having holes opening along the optical axes of said pairs traversed by said strings.

10. The improvement defined in claim 7 wherein said string vibration sensor includes a photoelectric emitter-detector pair straddling each string, said detectors being connected to a digital filter synchronized to a digitally controlled control frequency and a driving frequency that modulates said emitters whereby the synchronization of the modulating frequency to the digitally controlled center frequency eliminating any adverse effect of ambient lighting upon said sensors.

11. The improvement defined in claim 7 wherein a microprocessor is provided to scan said strings, said sensor having a full wave rectifier receiving an output of said sensor, and a fast peak detector connected to said sensor for generating an interrupt signal for said microprocessor to exclude scanning of inactive strings.

12. The improvement defined in claim 2, further comprising a respective string-bend sensor responsive to an off-axial bend of each string and outputting a signal which is applied to said synthesizer to control a parameter of music synthesizer thereby.

13. The improvement defined in claim 12 wherein each of said sensors comprises a photoelectric emitter-detector pair straddling each string and forming a photointerrupter.

14. The improvement defined in claim 13 wherein said pairs are disposed on a support plane perpendicular to said neck with holes being provided in said plane perpendicular thereto along optical axes of said pairs, said support forming said nut.

15. The improvement defined in claim 13 wherein said detectors of said pairs are connected to an ambient light rejecting system comprising a digital filter receiving outputs from said detectors and having a digitally controlled center frequency synchronized to a control frequency and a driving frequency that modulates the emitter of the pair whereby synchronization of the modulating frequency to the digitally controlled center frequency eliminates any effect of ambient lighting on the response of said sensors.

16. The improvement defined in claim 12 wherein each of said sensors includes a magnet and a Hall-effect detector mounted at said nut adjacent the respective string and responsive to bending thereof.

17. The improvement defined in claim 12 wherein each of said sensors includes a light source received adjacent each string and forming a reflective detector with respect to which the string forms a reflector.

18. The improvement defined in claim 2, further comprising a pressure sensor in said neck responsive to squeezing by a hand of a player for producing a control signal which is applied to said synthesizer.

19. The improvement defined in claim 2, further comprising a pressure sensor on said body above said bridge and responsive to pressure exerted by the heel of a strumming hand of a player for producing a control signal which is applied to said synthesizer.

20. The improvement defined in claim 2, further comprising a foot pedal controller connected to said body and said synthesizer and having a movable member shiftable by a foot of a player, means for supplying an infrared beam to said member, and means for receiving a reflection of said beam and producing an output in response thereto which is applied as a control signal to said synthesizer.

21. The improvement defined in claim 2 wherein said body is provided with a pickguard and a pickguard controller responsive to pressure applied to said pickguard for generating a control signal which is applied to said synthesizer.

22. The improvement defined in claim 2, further comprising a body-strike sensor on said body responsive to blows applied thereto by a player for outputting a control signal representing amplitude of vibrations of the body induced by said blows to said synthesizer.

23. The improvement defined in claim 2 wherein said body is provided with a thumb rest adjacent said strings, and means responsive to thumb pressure on said thumb rest for outputting a control signal to said synthesizer.

24. In a guitar controller for a music synthesizer having a guitar body, a neck extending from said body, an array of transversely spaced mutually parallel electrically conductive guitar strings extending along said neck from a nut at an upper end thereof to a bridge on said body, and a multiplicity of electrically conductive frets extending in transversely spaced relationship across said array of strings on said neck and below said strings, whereby said strings are depressed against said frets for note selection, the improvement which comprises in combination:

means responsive to depression of selected strings against selected frets for detecting the tone-generating length of the respective string and delivering a signal representing same to said synthesizer for generating a corresponding tone; and a string vibration sensor responsive to vibratory deflection of each string for defining for said synthesizer the inception and termination of the corresponding tone, each string vibration sensor including a photoelectric emitter-detector pair straddling a respective string and forming a photointerrupter, means for determining a slope of a signal generated by said photointerrupter to establish the inception of the corresponding tone and an automatic gain control for said photointerrupters increasing the gain of a signal outputted thereby as the outputted signal falls with time tc maximize the duration of the corresponding tone to termination.

25. In a guitar controller for a music synthesizer having a guitar body, a neck extending from said body, an array of transversely spaced mutually parallel electrically conductive guitar strings extending along said neck from a nut at an upper end thereof to a bridge on said body, and a multiplicity of electrically conductive frets extending in transversely spaced relationship across said array of strings on said neck and below said strings, whereby said strings are depressed against said frets for note selection, the improvement which comprises in combination:

means responsive to depression of selected strings against selected frets for detecting the tone-generating length of the respective string and delivering a signal representing same to said synthesizer for generating a corresponding tone; and a respective string-bend sensor responsive to an off-axial bend of each string and outputting a signal which is applied to said synthesizer to control a parameter of music synthesizer thereby.

26. The improvement defined in claim 25 wherein each of said sensors comprises a photoelectric emitter-detector pair straddling each string and forming a photointerrupter.

27. The improvement defined in claim 25, further comprising a pressure sensor on said body above said bridge and responsive to pressure exerted by the heel of a strumming hand of a player for producing a control signal which is applied to said synthesizer.

* * * * *